US006587754B2

(12) United States Patent
Hung et al.

(10) Patent No.: US 6,587,754 B2
(45) Date of Patent: Jul. 1, 2003

(54) SYSTEM AND METHODS FOR REMOTE MANAGEMENT OF STEAM GENERATING SYSTEMS

(75) Inventors: Stephen Lan-Sun Hung, Waterford, NY (US); Tara Healy Wight, Voorheesville, NY (US); Bang Mo Kim, Schenectady, NY (US); Lynn Ann DeRose, Gloversville, NY (US); Srinivas Krishnashamy Bagepalli, Niskayuna, NY (US); Jeffrey Lynn Schworm, Delanson, NY (US); Michael Edward Heeran, Latham, NY (US)

(73) Assignee: General Electric Company, Niskayuna, NY (US)

( * ) Notice: Subject to any disclaimer, the term of this patent is extended or adjusted under 35 U.S.C. 154(b) by 46 days.

(21) Appl. No.: 09/681,328

(22) Filed: Mar. 19, 2001

(65) Prior Publication Data

US 2002/0133270 A1 Sep. 19, 2002

(51) Int. Cl.[7] ..... G01K 1/08; G05D 11/00
(52) U.S. Cl. ..... 700/286; 700/291; 702/62
(58) Field of Search ..... 705/412; 700/90, 700/266, 274, 287, 286, 291; 702/81, 182, 188, 62; 703/7

(56) References Cited

U.S. PATENT DOCUMENTS 5,216,623 A * 6/1993 Barrett et al. ..... 340/870.27
5,424,958 A * 6/1995 Knupp ..... 307/153
6,122,603 A * 9/2000 Budike, Jr. ..... 340/870.02
6,366,889 B1 * 4/2002 Zaloom ..... 705/11

OTHER PUBLICATIONS

Patent application SN 09/385,510, filed Aug. 30, 1999 (RD–26819) Entitled: Utility Management System and Methods.

* cited by examiner

*Primary Examiner*—Leo Picard
*Assistant Examiner*—Alexander Kosowski
(74) *Attorney, Agent, or Firm*—Toan P. Vo; Noreen C. Johnson

(57) ABSTRACT

A steam-generation management system remotely measures amounts of utility used by steam-generating systems; monitors and compares their performance against benchmarked performance; analyzes and determines causes for variances in their performance; and recommends to the steam user actions for achieving optimum operation. The steam-generation management also permits remote access and interaction by the user and allows for integrating steam-related information into an overall strategy for managing steam and energy supply.

73 Claims, 8 Drawing Sheets

SYSTEM AND METHODS FOR REMOTE MANAGEMENT OF STEAM GENERATING SYSTEMS

BACKGROUND OF INVENTION

1. Field of the Invention

This invention relates to systems and methods for management of steam-generating systems and steam-consuming sites. In particular, this invention relates to systems and methods for remote monitoring and diagnostics of, for conveying information regarding steam-generating systems to information users, and for remote managing of steam-consuming sites. This invention also relates to systems and methods for integrating the management of steam-generating systems and steam-consuming sites in an overall energy management system incorporating telecommunication links.

2. Description of the Related Art

The United States Department of Energy has reported that over 45 percent of all the fuel burned by U.S. manufacturers is consumed to raise steam. It costs approximately $18 billion (1997 dollars) annually to feed the boilers generating steam. Many manufacturing facilities lose valuable resources because of poorly operating steams systems. U.S. manufacturers pay over three billion dollars in wasted fuel cost. Thus, a typical industrial facility stands to realize substantial savings by improving its steam system. In addition, by operating the steam generating systems more efficiently, emissions due to steam production would also be reduced.

Despite the potential for substantial savings, maintaining an efficient operation of steam generating systems has not received a high priority in many manufacturing facilities because it is often difficult to quantify the financial benefits of an optimized steam generating system. The cost of fuel for steam generation is normally not separable from the total plant fuel cost. In addition, it is often difficult to determine when the performance of these systems decreases to a level at which a maintenance action is warranted.

Therefore, it is desirable to have systems and methods for automatic monitoring and diagnostics of steam generating systems and for managing steam-consuming sites, which systems and methods can determine when the steam generating systems need to be serviced and present benefits of such service to decision makers. It is also desirable to have systems and methods that can determine and recommend the optimum operation of and schedule for steam generating systems in a facility. It is further desirable to provide systems and methods that can automatically take action to implement such an optimum operation and schedule. It is still further desirable to provide systems and methods to integrate the management of steam-generation systems and steam-consuming sites in an overall energy management system using telecommunication links.

SUMMARY OF INVENTION

A steam-generation management system of the present invention is capable of automatically and remotely monitoring and performing diagnostics on steam-generating systems. The steam-generation management system comprises means for measuring utility delivered to a steam-consuming site and steam-generating systems thereof; means for measuring and determining process parameters of the steam-generating systems and the steam-consuming sites; means for determining steam used at steam-consuming sites; means for analyzing and evaluating data on the steam generated and used and utility delivered to provide analyzed and evaluated data and information. The steam-generation management system further comprises means for presenting and means for providing access to results of such an analysis and evaluation to the steam-consuming sites or the steam user and means for recommending a course of action as to the operation of the steam-generating systems. Utility in this disclosure includes; but is not limited to; water; water treatment chemicals; fuel including natural gas, coal, fuel oil; and electricity.

In an embodiment of the present invention, the steam-generation management system also comprises means for taking action to optimize the operation and performance of the steam generating systems.

In another embodiment of the present invention, the steam-generation management system also determines the optimum sources of steam supply for a steam-consuming site or presents a strategy for achieving optimum cost for steam usage based on an analysis of alternate sources of energy supply used for steam generation. The steam-generation management system may be integrated into an overall energy management system of at least one steam-consuming site. The steam-generation management system also analyzes, evaluates, and presents information that can be used to develop future plans for steam generation and supply to steam-consuming sites.

The steam-generation management method of the present invention comprises the steps of measuring utility delivered to a steam-consuming site and steam-generating systems; determining process parameters of the steam-generating systems and the steam-consuming site; determining steam generated used and utility delivered at the steam-consuming site; analyzing and evaluating the steam generated and used and utility delivered. The steam-generation management method further comprises the steps of presenting and providing access to results of such an analysis and evaluation and recommending to the personnel of the steam-consuming site a course of action as to operation of the steam-generation system. In one aspect of the invention, the steam-generation management method of the present invention also comprises the step of taking action to optimize the operation and performance of the steam generating systems. In another aspect of the invention, the steam-generation management method further comprises the step of determining the optimum sources of steam supply for a steam-consuming site and presenting a strategy for achieving optimum cost for energy usage based on an analysis of alternate sources of energy supply. The steam-generation management method may also include the step of communicating information with an overall energy management system of at least one steam-consuming site. The steam-generation management method may also include the steps of analyzing, evaluating, and presenting information for a development of future plans for steam generation and supply to steam-consuming sites.

These and other aspects, advantages and salient features of the invention will become apparent from the following detailed description, which, when taken in conjunction with the accompanying drawings, in which like parts are designated by like reference characters throughout the drawings, disclose embodiments of the invention.

DETAILED DESCRIPTION

Figure 1:
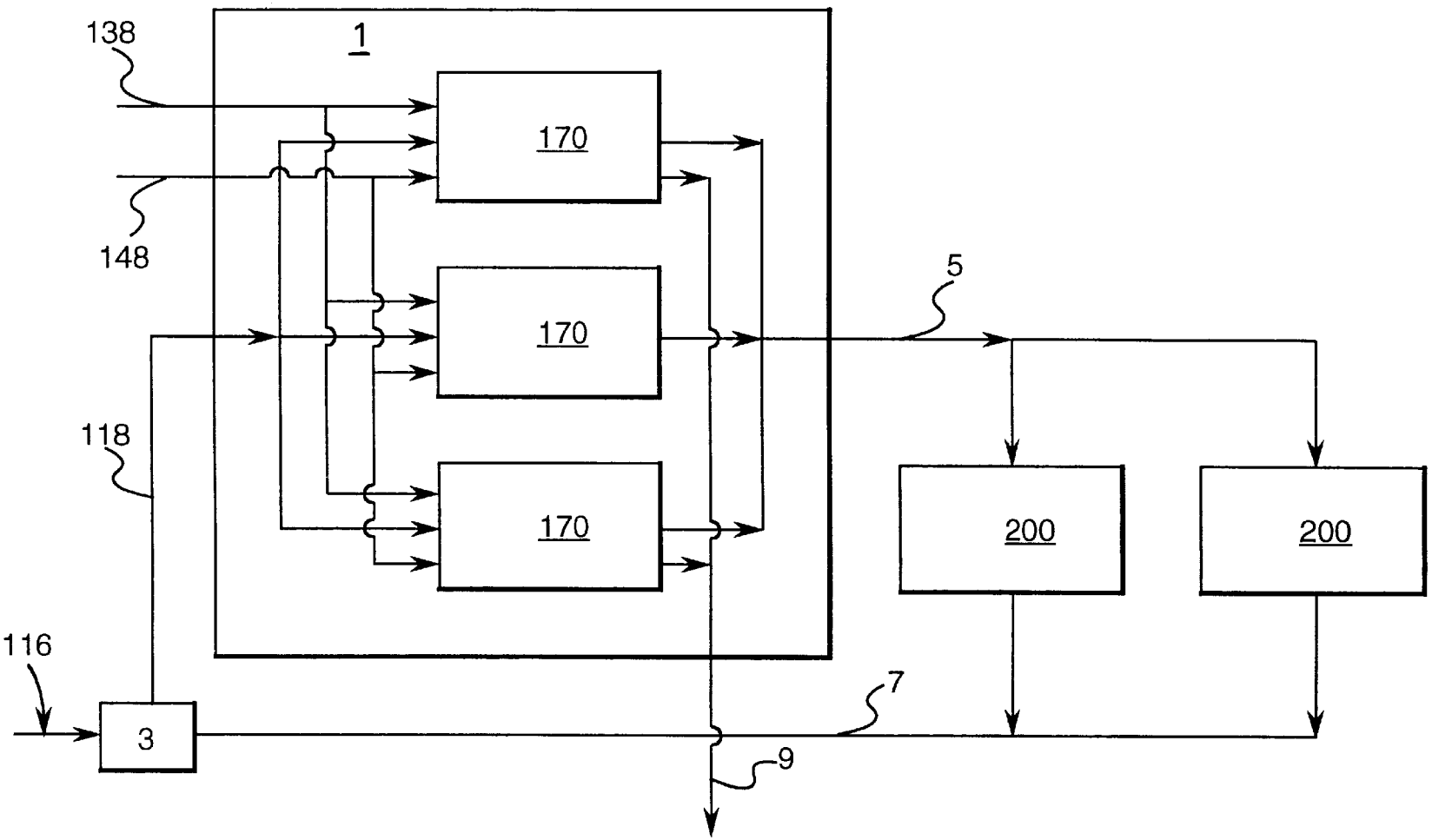
FIG. 1 is a simplified block, schematic diagram of a steam-generation system at a steam-consuming site.

FIG. 1 shows schematically a steam generation system at a steam-consuming site, such as a manufacturing plant or a facility that uses steam for heating. The steam generation system typically is located in steam generation area 1 and comprises a plurality of steam generation devices 170, such as boilers, that receive treated water from water treatment area 3 via line 118. Steam generation devices 170 also receive fuel, such as natural gas, fuel oil, or coal via line 138 for their burners (not shown) and electricity via line 148 for their blowers, fans, pumps, and other electrically driven devices (not shown). Steam is supplied to steam-consuming systems located, for example, at a production area 200 via line 5. Condensate from steam-consuming systems returns to the steam generation area via line 7. The condensate return may be treated in treatment area 3 before returning to the steam generation area 1. As required, undesirable accumulation is purged from the steam generation devices via line 9. Such a purge is often called a blow-down.

The steam-generation management system, as embodied by the invention, comprises steam-generation management system and aggregation systems, components, and tools (hereinafter referred to as "steam-generation management system tools"), and their associated methods of use. It is envisioned that the steam management system can operate independently or constitute a sub-system of an overall energy management system such as that disclosed in pending patent application Ser. No. 09/385,510; filed on Aug. 30, 1999; having the same assignee. The steam-generation management system tools can also determine aggregated steam use, for example, at one or more steam-consuming sites.

The steam-generation management system monitors the performance of steam-generating systems by collecting data on measurements of utility delivered to a steam-consuming site and used by the steam-generating systems and on operating parameters thereof and by collecting data on measurements of process parameters of steam-consuming systems or devices at the steam-consuming site. The steam-generation management system determines the expected performance characteristics of a steam-generating system when it is run efficiently, compares with the current operation of the steam-generating system, and analyzes variances in the performance characteristics. The steam-generation management system performs a diagnostic on the variances, presents the likely causes therefor, and makes a recommendation to the steam user regarding the operation of the steam-generating systems, such as a maintenance action or a redistribution of generation load among the steam-generating systems. Wherever appropriate hardware is provided, the steam-generation management system also may automatically take action by remote feedback control to bring the steam-generating system toward its expected optimum performance.

The term "steam user" is used in this invention disclosure in its singular form; however, the scope of the invention is inclusive of one or more steam users. A steam user may be a localized building, area, or process within a site. A steam user may include one multi-site company in a defined geographical area. Alternatively, the steam user may comprise one or more related or unrelated entities or companies, of any size, as described hereinafter, who have joined together to formulate and implement an overall strategy for their steam supply to take advantage of their combined purchasing power.

The steam-generation management system provides analyzed and evaluated data and information regarding steam and energy used to generate the supplied steam. The data and information are accessed for developing analytical strategies and methodologies that are usable to plan estimated future steam supply. The steam supply includes steam that is generated on site or purchased from other nearby steam suppliers. The analytical strategies and methodologies can be used for reducing the total steam supply costs and can permit a steam user to receive enhanced services from a utility provider on other utility-related matters. Further, the steam-generation management system comprises analytic tools that assist a steam user to analyze steam and utility use information and thus reduce risks associated with estimated future utility prices, plans, supplies and related matters.

The steam-generation management system applies analytical tools to steam generation, delivery, and use information to generate a total steam use profile ("TSUP"). The steam use information includes steam use data such as steam use amounts over time, and other steam-related variables, such as amounts of energy used ("energy use amounts") for steam generation, as needed by the steam user. The TSUP is also developed using steam usage needs information such as the local daily climate, production rates, and other pertinent factors. The TSUP comprises, but is not limited to, a summary of steam use data, for example a profile that includes at least one of summaries, graphs, charts, and quantifications of steam use, and steam-sensitive variables that influence steam use.

The steam-generation management system generates information for a steam user to plan steam supply and energy strategies. For example, the steam supply strategy includes whether, how, and when to invest in capital for the generation of additional steam to meet the estimated future steam usage and, where appropriate, whether and how much to purchase additional steam from off-site steam suppliers. This information could also be used by an overall energy management system to determine how, when, and from where to purchase energy for steam generation based on analytic tools and the TSUP.

The steam-generation management system 10, as embodied by the invention, will now be described with respect to FIG. 2. The illustrated embodiments are merely exemplary and are not meant to limit the invention in any way. The steam-generation management system 10 comprises at least one steam user component 50, which is disposed at a steam-consuming site 100. The steam-generation management system 10 also comprises at least one data processing module 20, that is in direct or indirect communication with the steam user component 50 over at least one communication link 30 (hereinafter "communication link"). Therefore, depending on the nature of the communication link 30 (discussed hereinafter), the data processing module 20 can have varied locations. For example, and in no way limiting of the invention, the data processing module 20 can be disposed at the steam-consuming site 100 or disposed remote therefrom, as long as data processing module 20 is connected in communication with the steam-consuming site 100.

The steam user component 50 comprises one or more utility use meters and other measuring devices or sensors that can provide information on the operation of the steam-consuming site. The utility use meters (hereinafter "meters") monitor and measure the delivered utility amounts. A meter may be a water meter 120 measuring the amount of water delivered to the steam-generation area 1 via water line 118; a chemical meter 130 monitoring and measuring the amount of a water treatment chemical, such as a corrosion or scale inhibitor, via line 128; a fuel meter 140 monitoring and measuring a fuel, such as natural gas, fuel oil, or coal used to generate steam, via delivery line 138; an electricity meter 150 monitoring and measuring electricity supplied to the steam generation area via electricity supply line 148. More than one meter may be installed for one utility if more than one source of that utility is used. The meters may also record specific steam user information, if desired, for later transmission over communication link 30 to a data processing module 20. Communication links 30 may be hard-wired or wireless telecommunication links that may be, but are not limited to, telephone lines with associated modems, radio frequency, microwave, or satellite transmission. A meter may store the steam user information for later transmission, if the communications link 30 comprises a dial-in modem, or other interface to a communication channel, that is not in continuous communication with the data processing module 20. If the communication links 30 are in continuous communication with the data processing module 20, then the meter need not record and store information. The following description refers to meters that monitor, measure, and record utility use information, however the recording of the utility use information is optional, depending on transmission capability of communication links 30. The scope of the invention includes any meter that can monitor, measure, and record utility usage information. The meters include, but are not limited to, digital meters, analog meters, mechanical meters, broad-band spectrum modems, process logic control meters, combinations thereof, and other equivalent devices.

Figure 2:
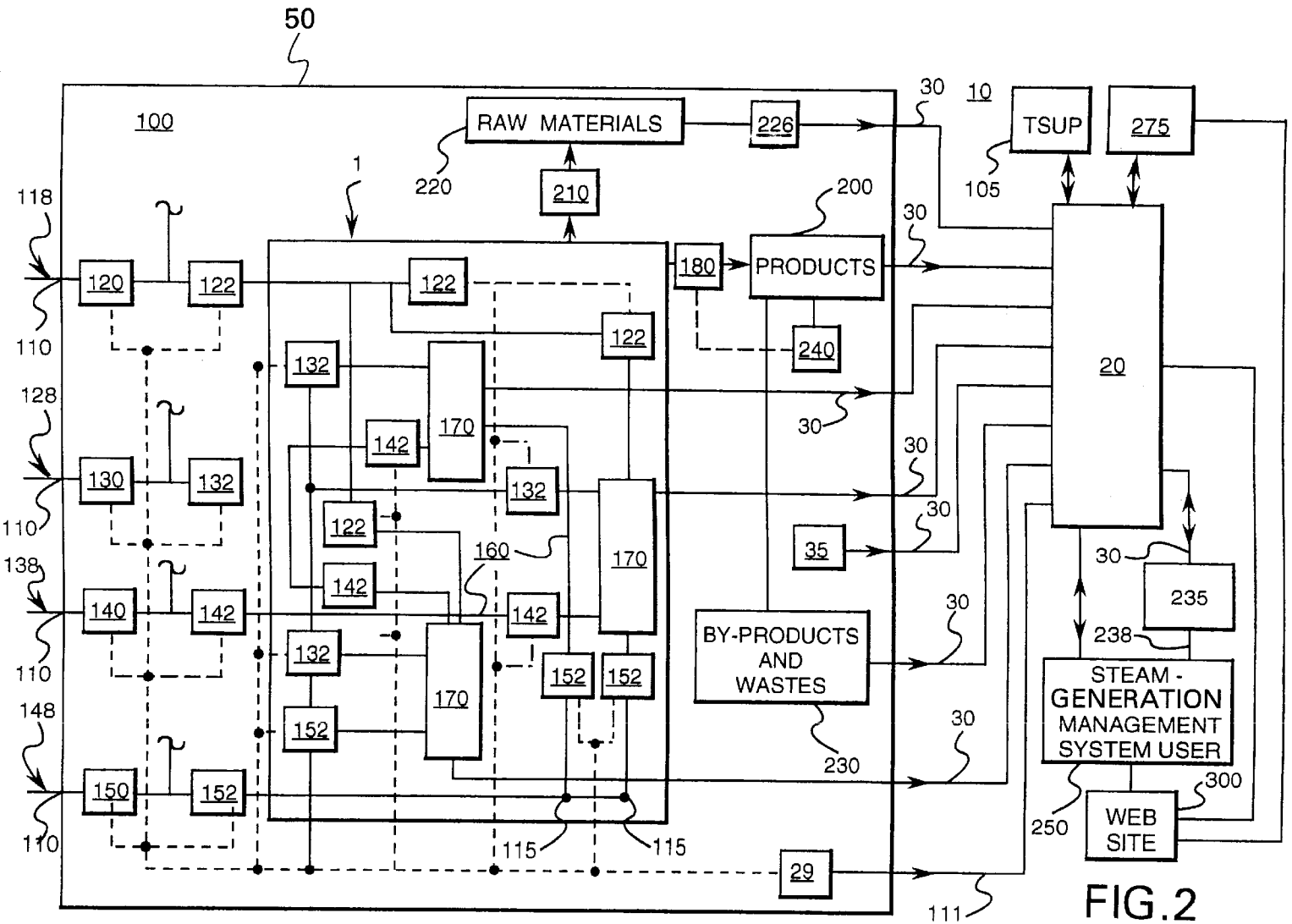
FIG. 2 is a simplified block, schematic diagram of a steam-generation management system of the present invention.

As illustrated in FIG. 2, meters 120, 130, 140, and 150 are disposed at an entry point 110 into the steam-consuming site 100 for each utility delivery line, 118 and 128, 138, and 148, respectively to determine the delivered utility amounts. Secondary meters 122, 132, 142, 152 may be disposed in the steam-consuming site 100, such as, but not limited to, disposed where utility delivery lines split and are diverted. For example, secondary meters 122 can be disposed along main and secondary delivery lines that lead to a steam-generation system 170. Therefore, amounts of utility used by individual steam-generation systems 170 can be measured, monitored, and recorded. Exemplary steam-generation systems 170 include, but are not limited to, boilers.

Also, as illustrated in FIG. 2, secondary meters 122 can be disposed at an ingress of a utility delivery line into a steam generation area 1. Thus, the amount of each utility used by each steam generation area can be monitored, measured, and recorded. Alternatively, secondary meters 1 22 can be placed at branch locations (also known as "nodes") 115 on utility delivery lines. Thus, the utility passage amount along utility delivery lines can be monitored, measured, and recorded, for example to determine leaks in water or gas pipelines or a high electrical resistance or mechanical obstruction at branch locations 115. The number, type, and location of the meters may be determined by the steam user, for example at the time the steam-consuming site is initially surveyed for design and installation of the steam-generation management system.

Each meter, 120, 122, 130, 132, 140, 142, 150, and 152, monitors, measures, and records utility amounts that pass along its respective delivery line. At appropriate locations, these meters also may measure and record other variables, such as the stream temperature, pressure, turbidity, particulate amount, dew point, etc. The meters can monitor and measure utility passage, and record utility passage amount data as a function of time. Also, the meters alternatively comprise multifunctional meters, which monitor and measure utility passage, and record energy passage amount data, along with additional steam-related variables. The additional steam-related and steam-dependent variables comprise, but are not limited to, date, time, location, ambient temperature, ambient pressure, and other steam-sensitive factors that may influence steam use amounts.

The meter-generated information may be transmitted to a meter data control unit 29. Meter data control unit 29 accumulates, organizes, and then transmits the meter-generated information to data processing module 20, to be incorporated in and compared against a TSUP. Meter data control unit 29 comprises an electronic unit that can provide differing functions, such as at least one of recording, storing, time stamping, summarizing, and then transmitting of meter-generated information to data processing module 20. For example, meter data control unit 29 can electronically accumulate the meter-generated information in the form of a spreadsheet, table, and other suitable information forms. Such information may be transmitted through hard-wired or wireless communication links as previously noted. Examples for meter data control unit 29 are microcomputers, work stations, mainframe computers, program logic controllers ("PLCs") with memory, or data acquisition electronic circuits having input and output ports. The meter-generated information is transmitted over communication link 31 to meter data control unit 29. Each communication link 31 transmits the meter-generated information in a rapid fashion, for example, but in no way limiting of the invention, electronically. Similarly, any meters directly connected to data processing module 20 also transmit the information in a rapid fashion over communication links 31. Communication link 31, and other communication links described hereinafter, include, but are not limited to, at least one of a phone modem, network connection, communication, radio communication and other wireless communication systems, cellular communication, satellite communication, web access communication (such as Internet or Intranet access communication), and combinations thereof.

The meter-generated information is typically configured by meter data control unit 29 to be conveniently incorporated in a TSUP 105 that is easily usable by data processing module 20. These configurations facilitate operation of data processing module 20. Such configurations include, but are not limited to, average steam use; steam use over short time periods, such as 15-minute time periods; long time periods, such as over a day, week, or month; aggregation of use from one or a plurality of sites; comparison of use with historical trending information; peak steam demand profiles; and combinations thereof. In addition, such configurations also include data on steam generation and other data on utility use. Alternatively, the configurations may be provided by data processing module 20, together with or separate from the meters. Meter data control unit 29 transmits the organized meter-generated information in a rapid fashion, for example, but in no way limiting of the invention, electronically. For example, the meter-generated information is provided over communication link 30. Alternatively, meter-generated information may be sent directly to data processing module 20 via communication links 30 and further organized in data processing module by software provided therein.

A TSUP is developed for analysis and evaluation by data processing module 20, which in turn can analyze and evaluate the steam amounts and provide other utility use information. In this case the TSUP provides a current status and operation of the steam-generating systems and steam-consuming site. The TSUP may comprise steam and other utility use data for each steam-consuming site 100. Information for the TSUP may also include information for each steam user component 50; steam-consuming systems, such as those located at production area 200 or raw material storage and handling area 220, and each individual meter at an energy-consuming site 100. The TSUP content may be customized, for example, by a steam-generation management system user 250.

In the case the meter-generated information is collected and organized by meter data control unit 29, it is further transmitted to data processing module 20 over communication link 111. TSUPs 105 of one or more steam users are collected and stored by data processing module 20. Data processing module 20 analyzes and evaluates the collected data, and can comprise any device that can collect data, evaluate, and analyze data. For example, and in no way limiting of the invention, data processing module 20 comprises an analytical and electronic device, such as a main frame computer, a PLC, a data acquisition microcomputer, an analog-to-digital (A/D) converter, a digital-to-analog (D/A) converter, or combinations thereof. Data processing module 20 alternatively can comprise other appropriate solid-state devices that can collect, evaluate, and analyze data. Data processing module 20 alternatively comprises a central processor for overall, system-level control, and separate sections performing various different specific combinations, functions, and other processes under control of the central processor section. It will be appreciated by those skilled in the art that data processing module 20 can also be implemented using a variety of separate dedicated, programmable integrated, and other electronic circuits or devices. These devices include hardwired electronic, logic circuits including discrete element circuits and programmable logic devices. Data processing module 20 can also be implemented using a suitably programmed general-purpose computer, such as, but not limited to, a microprocessor, micro-control, or other processor device, for example, at least one central processing unit (CPU) or micro-processing unit (MPU), either alone or in conjunction with one or more peripheral data and signal processing devices. As necessary, unit 20 also may be supplemented by personnel trained to analyze and respond to the data.

Data processing module 20 can analyze TSUP 105 for each energy user component 50. Data processing module 20 can also analyze the data on energy use in the steam generation together with other process variables, to provide complete information on total steam use. Data processing module 20 is provided, either programmed with or loaded therein at the time of transmission of steam use data, with particulars of steam-consuming site 100 to determine a TSUP. The particulars may include an amount of product produced by a known amount of raw material with known amounts of by-products and waste using set amounts of steam and energy. Also, an expected amount of product produced by a known amount of raw material with known amounts of by-products and waste factor in determining the operational efficiency of the steam-consuming site 100 can be provided to data processing module 20.

The individual meters of steam-generation management system 10 may comprise multifunctional meters that provide process variable information to data processing module 20, preferably through meter data control unit 29, which may preliminarily organize the data. The process variable information includes, but is not limited to, production rates, time, date, temperature, humidity, location, and other process-influencing variables. Alternatively, steam-generation management system 10 comprises a separate process variable information-providing unit 35, which can provide the process variable information for a TSUP to the data processing module 20. Unit 35 may contain historical formation on the operation of a process, such as process capability over time, production rate of a certain product with respect to utility and raw material input, etc. Variable information-providing unit 35 may be provided in combination with multifunctional meters.

Other process variables that are provided to develop a TSUP include, but are not limited to, raw material information from a raw material information unit 226, by-product and waste information from a by-product and waste (heat) information unit 230, and product information from a product information unit 240. These process variables are merely exemplary, and are not meant to limit the invention in any way. Furthermore, information units 226, 230, and 240 may be combined into one integral information unit.

Another process-variable is ambient temperature. Ambient temperature will influence steam used, for example, because of the efficiency of the steam line insulation and heating requirement for work areas. Further, ambient temperature may also influence operations of a steam-consuming system, such as a piece of manufacturing equipment at production area 200. For example, if the production area 200 comprises an extruder that operates at a predetermined temperature, such as 250° C., and the ambient temperature is 10° C., more steam will be used to maintain the extruder temperature if steam is used to heat trace the extruder or to heat the raw material before being fed into the extruder, compared to a higher ambient temperature, for example 30° C., since less extruder heat will be lost to the surrounding environment. Steam supplied to such a production area may be measured by meter 180.

A further process-variable comprises the raw material type. The raw material type may influence the amount of steam used at the steam-consuming site 100, and its data may be provided by a raw material information unit 226. For example, raw material may be contained in storage silos that are heat traced by steam. If the steam-consuming equipment at production area 200 comprises an apparatus that first melts raw material using steam heat, differences in raw material melting temperature may influence the steam amounts used. If a provided raw material has a higher melting temperature than average raw materials, for example due to impurities in the raw material, steam amounts used to melt the provided raw material may vary and cause more steam to be used on melting the raw material. Steam supplied to such a raw material storage and handling area may be measured by meter 210.

The by-products and waste amounts for the steam-consuming site 100 may similarly influence the steam amounts used. The by-products and waste amount data are provided by a by-product and waste information unit 230 that can measure by-products and waste amounts. For example, if a by-product of a steam-consuming site 100 comprises heat and if large amounts of heat above an average amount of by-product heat are produced, a possible inefficient steam use exists. The steam-generation management system 10 will advise a steam user of such an occurrence.

Further, reducing the amounts of by-products and waste for the steam-consuming site 100 can represent an environmental and pollution control benefit of the steam-generation management system 10. For use as in environmental and pollution control, the steam-generation management system 10 measures steam used by the steam-consuming site 100 and the individual steam-consuming areas, such as 200 and 220. The amounts of pollution produced per unit steam generated at each steam-consuming site 100 are known, for example from previous benchmarking and measurement. Thus, steam-generation management system 10 can function to determine amounts of pollution produced by measuring the amount of steam generated. The determined amounts can be useful to determine if steam-generation systems are operating efficiently and not expelling abnormal amounts of pollution when the amounts of steam generated and used are consistent with benchmarked amounts, or operating inefficiently, such as when amounts of steam generated are significantly larger than benchmarked amounts and more pollution is being produced.

A still further process variable comprises product output information that can be provided by product information from a product information unit 240. The product output, for example, parts produced over time or parts produced per steam unit by production area 200, is provided to formulate the TSUP. The product information unit 240 provides manufacturing information regarding the efficiency of the overall steam-consuming site 100 and production area 200. The manufacturing product output information includes, but is not limited to, product parts output, production run times, downtimes, and other manufacturing variables and characteristics. Product information unit 240 gathers measurements from sensors or meters that measure and record these variables. The manufacturing product output information is useful in formulating a TSUP.

Data processing module 20 is also provided with energy-provider data for evaluation of a TSUP. The energy-provider data typically includes energy unit prices, delivery tariffs, energy taxes, and other data that may influence the energy price. The provider data can be provided directly from an energy-provider, for example, from an energy-provider data center 235 over a communication link 30. Examples of energy-provider data centers 235 include energy-provider web pages, call-in energy-provider price updates services, and other real-time means to provide information to the data processing module 20.

The energy-provider data is typically provided in electronic form. The electronic data may be read directly into the data processing module 20. The steam-generation management system user is also directly connected to data processing module 20 over a communication link 238. Therefore, steam-generation management system user 250 is able to access energy-provider information. The steam-generation management system user is able to discover an energy provider's current energy prices. The steam-generation management system may compare energy prices from various energy sources, and provides guidance to choose a desirable energy price. The energy-provider data is alternatively provided to steam-generation management system user 150 in other forms, such as, but not limited to, oral, paper, telegraphic, pager, and non-electronic forms, which will be entered into the data processing module 20.

Energy-provider data may also comprise energy delivery information. This energy delivery information permits data processing module 20 to determine energy delivery routes for each energy consumption site 100. The energy delivery route is an important factor for consideration in a TSUP and determination of a final total energy price, as the final total energy price can include energy costs, delivery costs, energy loss costs, tariffs, taxes, transportation costs, and other energy-related costs. Energy delivery routes influence energy costs due, at least in part, to associated transportation taxes and tariffs, time delays in delivery, and energy loses during delivery.

Another benefit of steam-generation management system 10 arises from a service center 275. The service center 275 permits the steam-generation management system, as embodied by the invention, to monitor analyzed information from data processing module 20. The service center 275 can then provide customer service and further monitoring, analysis, and evaluation of the information from data processing module 20. Each of data processing module 20 and the service center 275 can send alerts to steam-consuming site 100 and steam-generation management system users 150 if a "critical" event occurs. These critical events include, but are not limited to, extreme energy shortages or surpluses, determination of an optimized process by statistical analysis of certain process variables, possible energy losses as determined from analysis by data processing module 20, very low or high energy prices, and changes in economic indicators. The alerts can be sent automatically by each of the data processing module 20 and the service center 275, and may also be sent manually. The alerts, which can include updates to previous alerts, are sent by any appropriate communication mode, such as, but not limited to, regular mail, e-mail, telephone call, pager, facsimile, Internet messages, and similar communications.

Data processing module 20 includes software for data acquisition, data mining, and data analysis. Data processing module 20 may also include software to provide a total quality management of the systems at the steam-consuming site. Such software may include tools to provide a determination of process capability, execution of process optimization, and design for quality engineering, as well known in the art. The software enables steam management analysis, as embodied by the invention. The software also enables purchasing, predicting steam and energy use and price trends, and planning decisions to be made based on analyzed and evaluated information. The above-mentioned software, alone, or in combination with one or more information relating to production, energy providers, and the general economy, provides means for purchasing, predicting, and planning.

Data processing module 20 develops transfer functions to analyze and evaluate, and predict the TSUP and other steam- and energy-related information. The transfer functions that are developed by data processing module 20 include operational and manufacturing needs. The transfer functions typically are results of regression analysis operations that model utility demand based on production, ambient conditions, steam-generating systems 170, mode of operation, and other steam-related factors. These predictive analytical tools enable steam-generation management system 10 to predict estimated future steam needs and use in response to input variables. These transfer functions are dependent on the nature of the utility (including energy), energy-provider controlling factors, steam-consuming site 100 particulars, details of steam-generating systems 170, manufacturing or operating process variables, and other such factors. Thus, the user of steam-generation management system 10 can use the system to develop estimated future energy use, develop predictive analytical tools, develop purchasing schemes, and develop other estimated future steam- and energy-related tools.

Steam-generation management system 10 provides interactive participation for steam-generation management system users, such as over a web hook-up. Steam-generation management system 10 can be password protected, if it is desired that access to the steam-generation management system be limited. Other means of protecting the information, such as, but not limited to, encryption routines, and other electronic protection schemes, that allow for controlled access, are within the scope of the invention.

The information generated by steam-generation management system 10 can be made available to a steam-generation management system user 250, for example, on a web site 300. The web site 300 can also be connected to data processing module 20 and service center 275 over communication links 30, such as those previously mentioned. FIGS. 3–6 are exemplary charts and graphs that may be included on a web site, as embodied by the invention. The web site can include options that provide interactive user participation. These user-participation options include, but are not limited to, dashboards that monitor demand, alarm functions that generate alerts during the above-discussed critical events, including high and low energy prices and peak demand periods, and an "options" button that provides alternatives for reducing or delaying steam and energy use until another time. The options may also include accepting or delaying taking action on a recommendation for maintenance of a steam-generating system.

Steam-generation management system 10 using a web site 300 provides a further benefit to a user by being able to provide real-time information to steam-consuming site 100 personnel who can readily benefit from the information. In the past, evaluations of the operation of steam-generating system 170 occurred irregularly, and normally may not be transmitted to an operator of a steam-consuming site 100 in an expedient manner. With steam-generation management system 10, steam-consuming site 100 personnel who are actually operating and controlling various steam-consuming systems, such as production equipment in production area 200, and steam delivery systems can quickly obtain analyzed and evaluated information, which is provided in a form that is valuable and easy to use. For example, an operator of a steam-consuming system can obtain information concerning the operation of the steam-consuming system quickly so as to avoid undesirable energy wastes that may result from inefficient operation of the steam-consuming system. With the real-time analyzed and evaluated information from steam-generation management system 10, the operator of the steam-consuming system can take immediate steps to resolve any potentially costly wastes of energy that may otherwise have resulted. Also, with the real-time analyzed and evaluated information from steam-generation management system 10, steam and energy information feedback from a user or a customer can be received via the web (e.g., Internet or Intranet).

Figure 3:
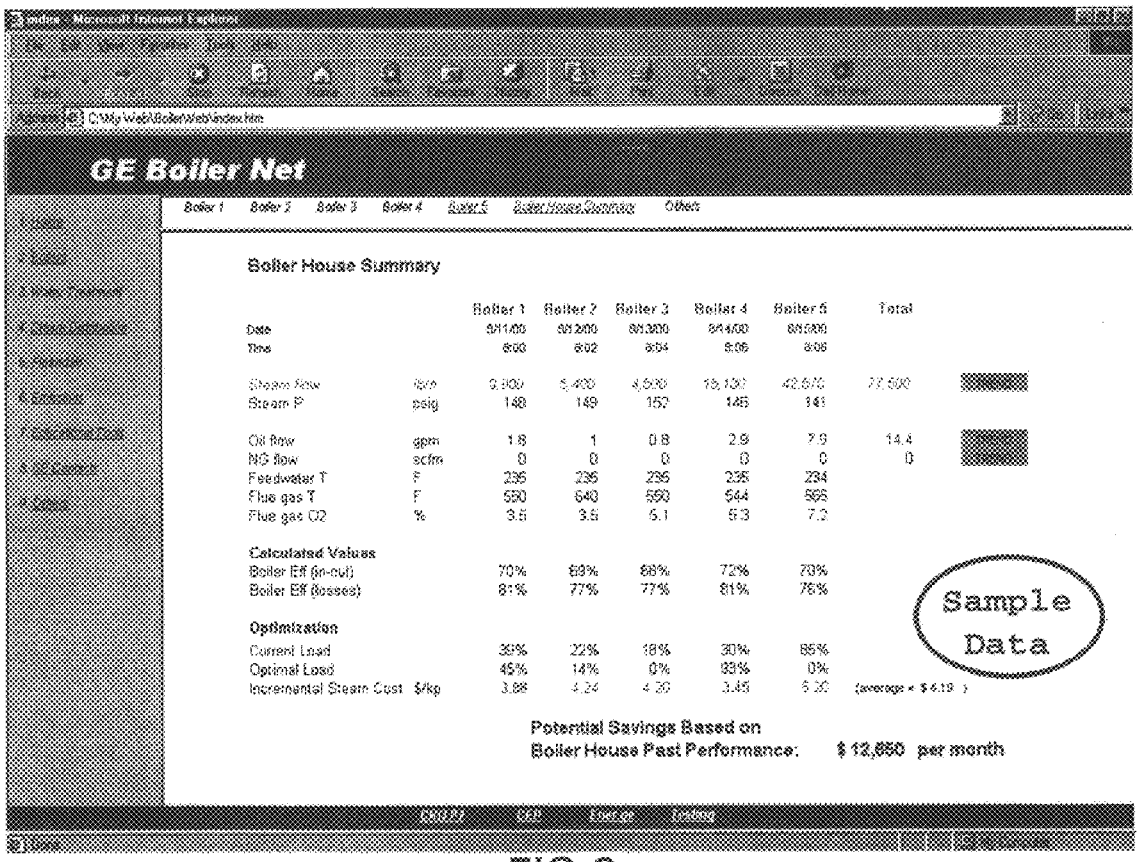
FIG. 3 is an example of a spreadsheet summary of the operation of steam-generating systems at a steam-consuming site provided by the steam-generation management system of the present invention.
Figure 4:
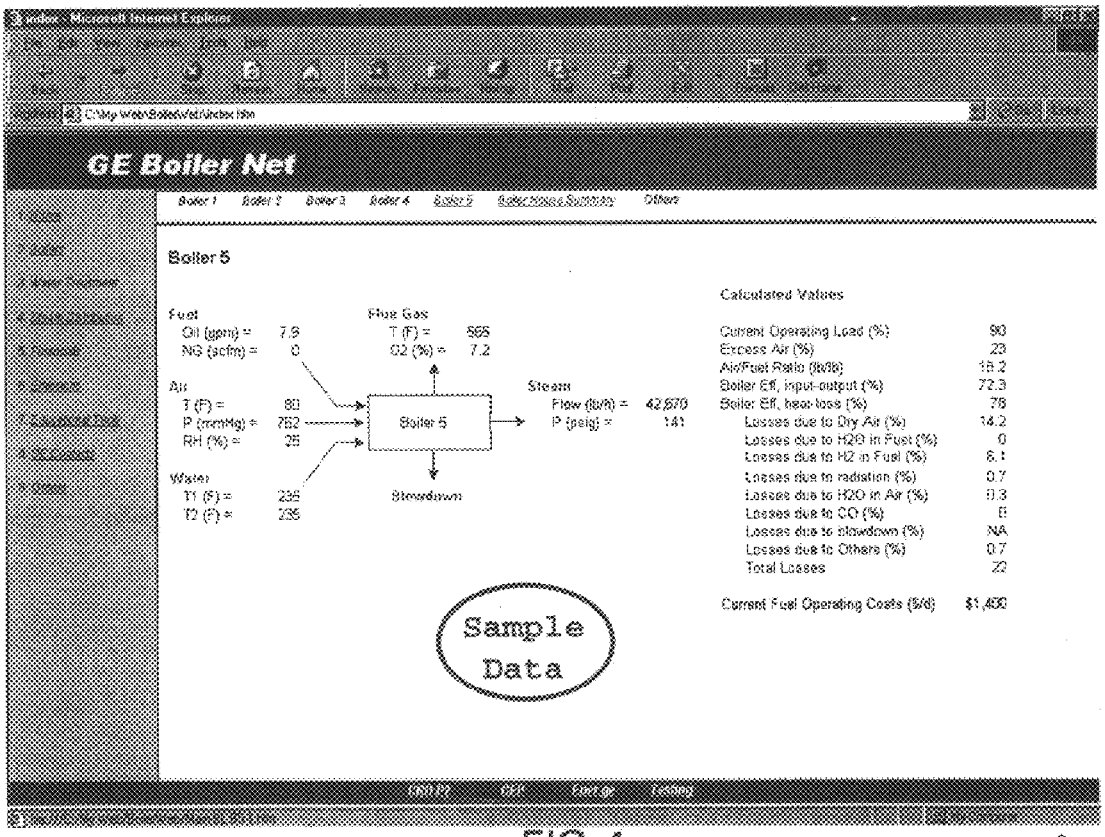
FIG. 4 is an example of a presentation of real-time performance parameters of a steam-generating system as provided by the steam-generation management system of the present invention.
Figure 5:
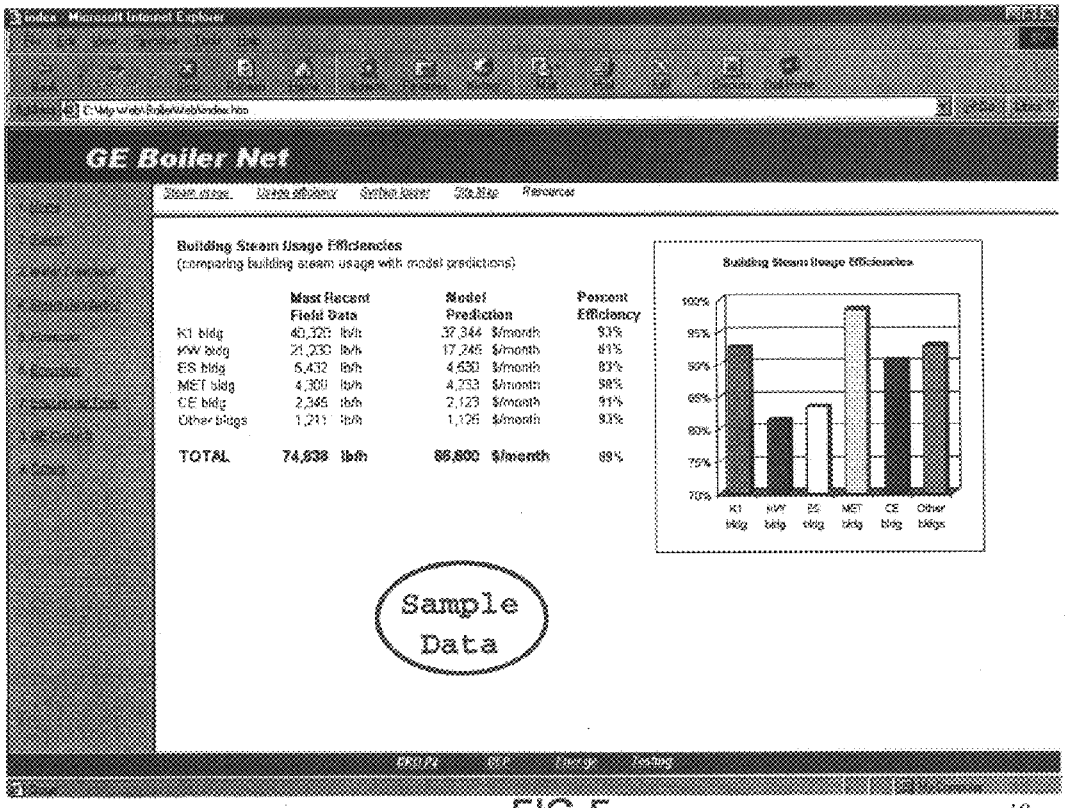
FIG. 5 is an example of a tabular and graphical presentation of steam usage by various steam-consuming areas at a steam-consuming site.
Figure 6:
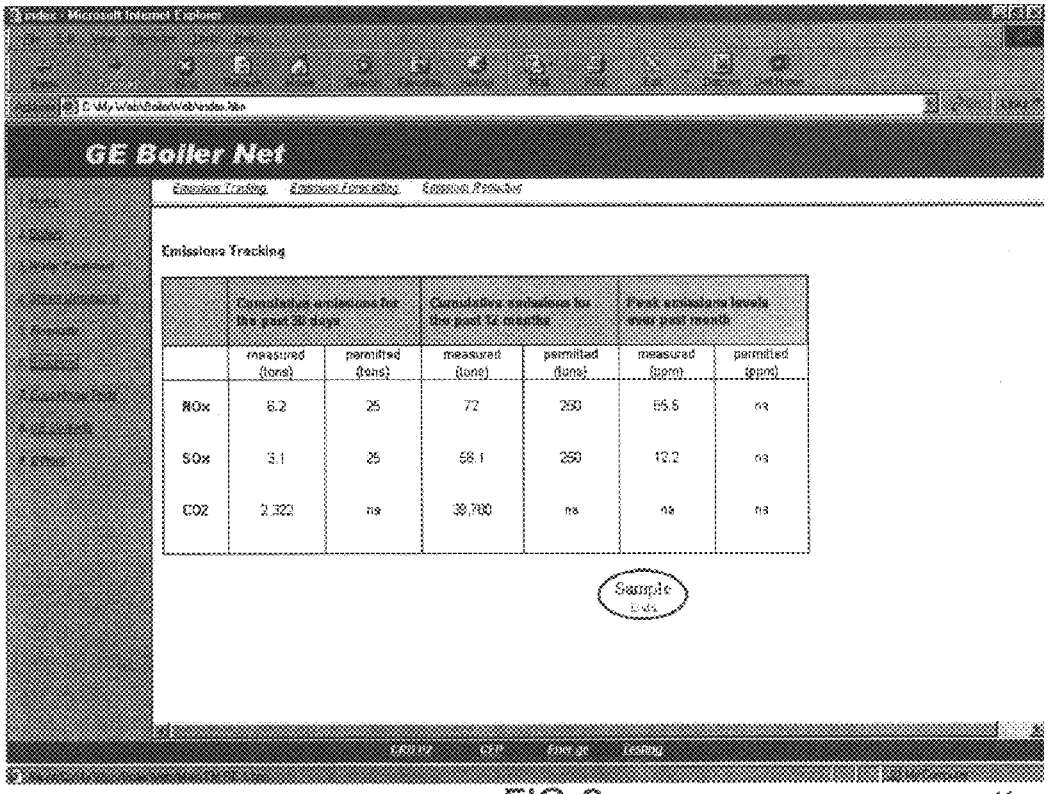
FIG. 6 shows an example of the results of emission tracking available from the steam-generation management system of the present invention.

FIG. 3 is an example of a tabular summary of the operation of the steam-generating systems at a steam-consuming site. In this case, the site operates five boilers for steam generation. Steam production, fuel usage, boiler efficiencies, and boiler load are presented to the steam-generation management system user. In addition, an optimum boiler load distribution among the boilers and potential savings for operating at optimum load distribution are also presented. In FIG. 4, the real-time operating parameters of a boiler are presented along with itemization of energy losses due to various factors. FIG. 5 is a tabular and graphical representation of steam usage by various buildings at a steam-consuming site. The current expenditure for steam consumption is also prominently available to the user so that the user is more aware of the penalty of an inefficiently operated steam-generating system. FIG. 6 illustrates the available information on emissions from the steam-generating systems compared to allowable amounts of emission. Thus, the steam-generation management system instantaneously informs the user on his compliance status. Appropriate actions may be taken if compliance is not met to avoid operating disruption or fines. This information can also allow the user to observe the operating trend for the steam-generating systems and to foresee and plan for maintenance. Information presented in FIGS. 3–6 is available to the user via remote access by the Internet or Intranet.

Figure 7:
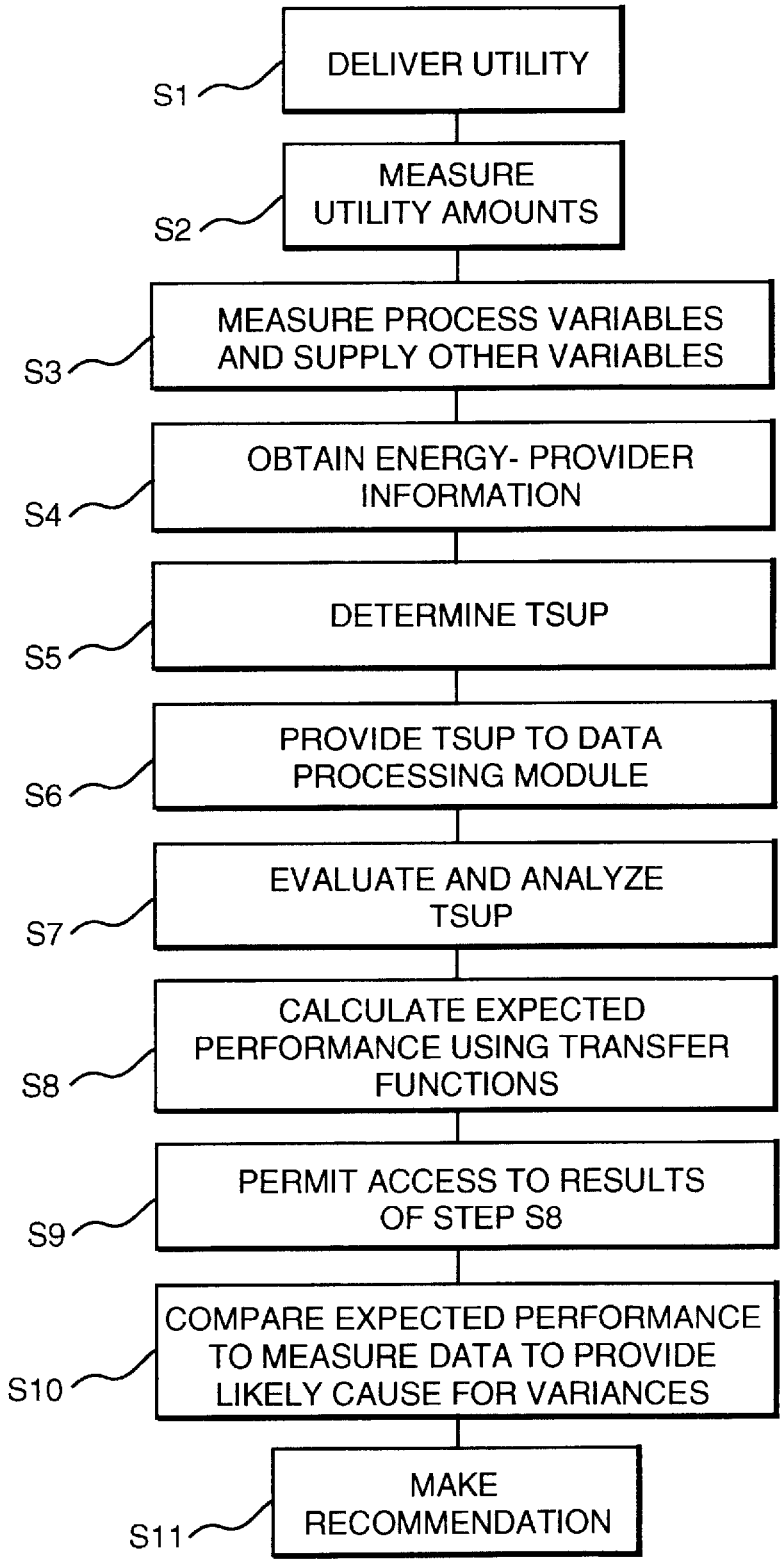
FIG. 7 is a flow chart of an operation of the steam-generation management system.

An exemplary operation of steam-generation management system 10, as embodied by the invention, will now be discussed with reference to the flow chart of FIG. 7. The following operation is merely one operational method of steam-generation management system 10, and the scope of the invention comprises other methods of steam-generation management system 10 that also achieve the goals of such a steam-generation management system.

The utility is delivered to the steam-consuming site 100 in step S1. Meters then measure the amounts of utility delivered to steam-consuming site 100 in step S2. Process variables are then measured in step S3 and provided to data processing module 20. The process variables may be measured by one of the meters or supplied by variable information-providing unit 35, or a combination thereof.

Energy-provider information may then be obtained in step S4, for example from energy-provider data center 235. The step of obtaining of the energy-provider information in step S4 is optional. Methods for using steam-generation management system 10, without energy-provider information, may also provide useful steam use information, such as evaluated and analyzed information concerning steam use by steam-consuming site 100, compared to historical steam use information, and similar information.

Next, in step S5, a TSUP is determined that reflects the current status and condition of a steam-consuming site. For example, a total steam use profile for an aggregate of steam users or for a single steam-consuming site 100 can be determined. The TSUP is then provided to data processing module 20 in step S6. Step 5 may be by-passed if only one steam user or one steam-consuming site is managed by the steam-generation management system.

Data processing module 20 evaluates and analyzes the TSUP in step S7. In step S8, data processing module 20 uses transfer functions previously developed for the steam-consuming site to provide its expected performance, for example in terms of steam generation, steam and energy consumption, pollution emission by the site. The transfer functions and their results can be accessed by users of steam-generation management system 10 in step S9. Results are compared to the incoming data describing the current status and condition of the steam-consuming site and likely causes for variances are presented in step S10. In step S11, data processing module 20 makes recommendations for maintenance or optimization of steam generating systems, for steam load distribution among the steam generating systems, and for steam and energy use, purchasing, planning, and other steam- and energy-related activities, as embodied by the invention.

Figure 8:
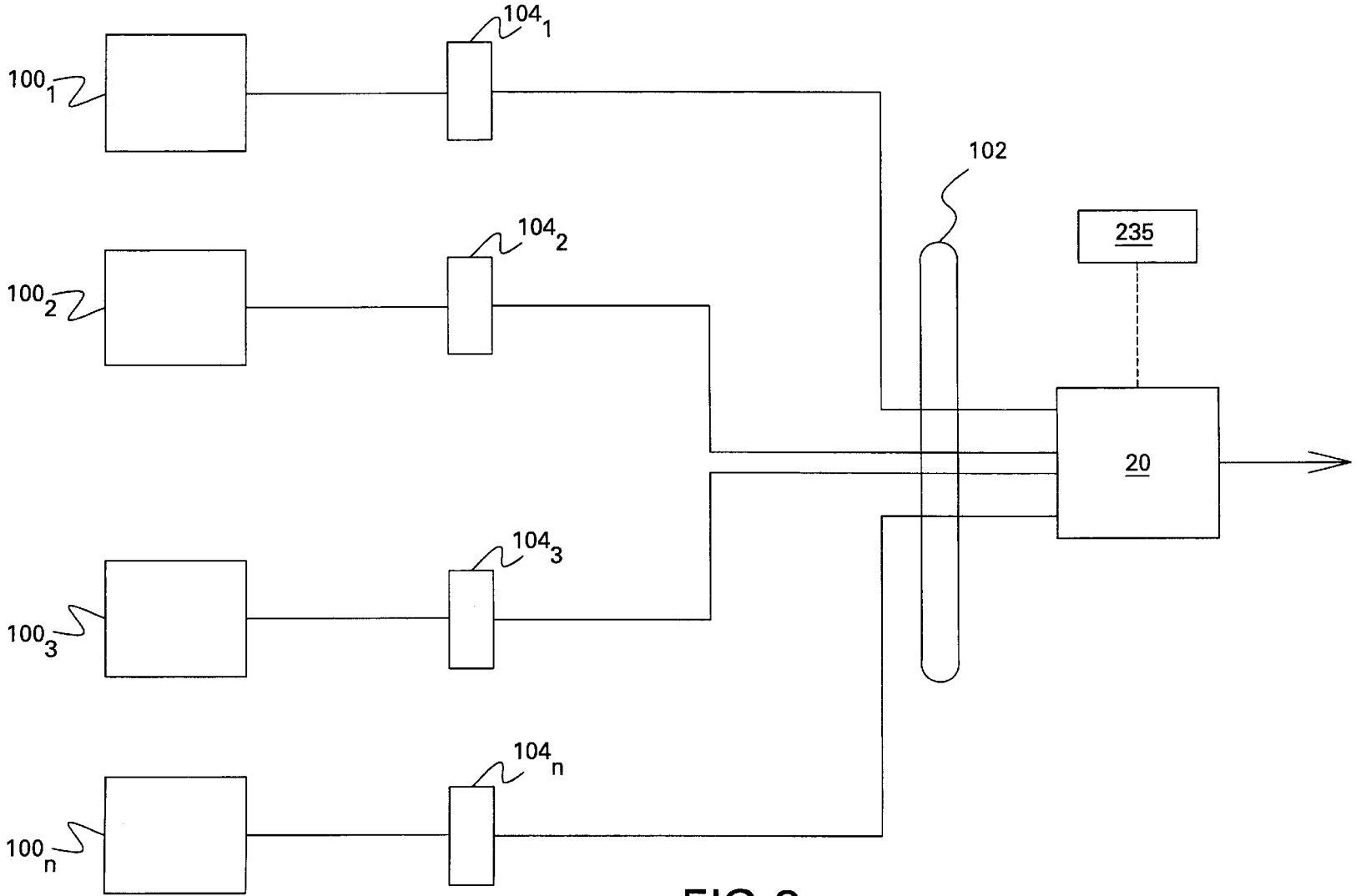
FIG. 8 is a simplified block, schematic diagram of a steam aggregation system with a plurality of steam-consuming sites.

Steam-generation management system 10 as illustrated in FIG. 2 is disposed at a single steam-consuming site 100, for development of a TSUP for steam-consuming site 100. Alternatively, a plurality of steam-consuming sites can each have a steam-generation management system disposed thereat for development of an individual TSUP, or a single site may be sub-divided into many steam usage "areas or "processes". This configuration of the plurality of steam-generation management systems 10 is illustrated in FIG. 8. In FIG. 8, steam-consuming sites $\mathbf{100}_1$, $\mathbf{100}_2$, $\mathbf{100}_3$, . . . , $\mathbf{100}_n$ (for n steam-consuming sites) are interconnected, for example, over a data processing module link 102 to a data processing module 20. The plurality of steam-consuming sites $\mathbf{100}_1$, $\mathbf{100}_2$, $\mathbf{100}_3$, . . . , $\mathbf{100}_n$ may comprise any number of sites, for example, sites from a single commercial entity, such as a large multi-location company. Steam-consuming sites $\mathbf{100}_1$, $\mathbf{100}_2$, $\mathbf{100}_3$, . . . , $\mathbf{100}_n$ may alternatively comprise a plurality of independent companies that have joined together in an attempt to benefit from the commercial entity, such as a large multi-location company. Steam-consuming sites $\mathbf{100}_1$, $\mathbf{100}_2$, $\mathbf{100}_3$, . . . , $\mathbf{100}_n$ may alternatively comprise a plurality of independent companies that have joined together in an attempt to benefit from the capability of the steam-generation management system 10, as embodied by the invention.

As a further non-limiting alternative, steam-consuming sites $\mathbf{100}_1$, $\mathbf{100}_2$, $\mathbf{100}_3$, . . . , $\mathbf{100}_n$ may comprise a plurality of companies in a joint venture. Each steam-consuming site $\mathbf{100}_1$ (i=1, 2, . . . , n) comprises at least one steam-generation management system 10 that develops a TSUP $\mathbf{104}_1$, $\mathbf{104}_2$, $\mathbf{104}_3$, . . . , $\mathbf{104}_n$. Each TSUP is transmitted to data processing module 20 over communication link 102, where data processing module 20 analyzes and evaluates the total energy use profile, individually or in combination with energy-provider information 235.

Steam-generation management system 10 can be offered as a service by energy management service provider. Alternatively, it also may be offered by steam- or electricity-generating equipment manufacturers or utility providers, such as utility companies, to its current and potential steam users. Such a service provider can use steam-generation management system 10 to determine how much steam has been used, historical steam use trends, estimated future steam needs for a single steam user or a group of steam users. Steam-generation management system 10 may also permit the utility provider to plan for and determine how to apportion energy to each of its customers, based on the individual customer's needs. Therefore, a utility provider can apportion needed energy, as determined by steam-generation management system 10 to each steam-consuming site 100 and can avoid blindly making decision regarding energy apportionment.

While various embodiments are described herein, it will be appreciated from the specification that various combinations of elements, variations, equivalents, or improvements therein may be made by those skilled in the art, and are still within the scope of the invention.

What is claimed is:

1. A steam-generation management system comprising:

means for measuring amounts of utility delivered to a plurality of steam-consuming sites that are interconnected on a computer-based network, each of the plurality of steam-consuming sites comprising at least a steam-generating system; the utility comprising water, water treatment chemicals, energy, and fuel;

means for measuring process parameters of the at least a steam-generating system and the plurality of steam-consuming sites;

means for determining steam amounts generated and used at the plurality of steam-consuming sites;

means for analyzing and evaluating the steam amounts generated and used and utility delivered to provide analyzed and evaluated data and information; and means for providing access to the analyzed and evaluated data and information and steam-related information.

2. The system according to claim 1, wherein each of the plurality of steam-consuming sites comprises at least one steam-consuming system.

3. The system according to claim 2, wherein the at least one steam-consuming system comprises a plurality of steam-consuming systems.

4. The system according to claim 1, wherein the fuel comprises at least one of natural gas, coal, fuel oil, and combinations thereof.

5. The system according to claim 1, wherein the energy comprises electricity.

6. The system according to claim 1, wherein the water treatment chemicals are used to treat water to be fed to a steam-generating system.

7. The system according to claim 1, wherein the means for measuring amounts of fuel, energy, water, and water treatment chemicals comprises at least one meter for each of water, water treatment chemicals, energy, and fuel.

8. The system according to claim 7, wherein the at least one meter comprises a meter selected from the group consisting of digital meters, analog meters, mechanical meters, broad-band spectrum modems, process logic control meters, and combinations thereof.

9. The system according to claim 7, wherein the at least one meter comprises a meter disposed in cooperation with a delivery line that delivers water, water treatment chemicals, energy, and fuel to each of the plurality of steam-consuming sites.

10. The system according to claim 9, wherein the meter that is disposed in cooperation with the at least one delivery line comprises a meter disposed prior to the plurality of steam-consuming sites in a position sufficient to measure total utility amounts delivered to the plurality of steam-consuming sites.

11. The system according to claim 10, wherein the utility is delivered by a method selected from the group consisting of delivery vehicles, a combination of delivery vehicles and pipeline, and a combination of delivery vehicles and electrical line.

12. The system according to claim 9, wherein the meter that is disposed in cooperation with the at least one delivery line comprises a meter disposed prior to each steam-generating system in the plurality of steam-consuming sites in a position sufficient to measure utility delivered to each steam-generating system at the plurality of steam-consuming sites.

13. The system according to claim 1, further comprising communications links between each of the means for measuring, means for determining, the means for analyzing and evaluating, and the means for providing.

14. The system according to claim 13, wherein the communications link is selected from the group consisting of phone modem, network connection, communication, radio communication and other wireless communication systems, cellular communication, satellite communication, web access communication, and Internet access communication, Intranet access communication, and combinations thereof.

15. The system according to claim 1, wherein the means for analyzing and evaluating the steam amounts generated and used comprises at least one data processing module.

16. The system according to claim 1, wherein the means for determining steam amounts generated and used at the steam-consuming site and the means for analyzing and evaluating the steam amounts generated and used comprise a data processing module.

17. The system according to claim 1, wherein the means for analyzing and evaluating the steam amounts generated and used comprises means for providing energy-provider information for evaluation and analysis, wherein the energy-provider information resides remotely from the means for analyzing and evaluating, and is communicated to the means for analyzing and evaluating via at least a communication link.

18. The system according to claim 17, wherein the energy-provider information is provided as real-time information.

19. The system according to claim 18, wherein the energy-provider information is provided in electronic form.

20. The system according to claim 19, wherein the energy-provider information comprises at least one of energy unit prices, delivery tariffs, energy taxes, and combinations thereof.

21. The system according to claim 1, wherein the means for analyzing and evaluating the steam generated and used comprises means for providing utility delivery information for evaluation and analysis.

22. The system according to claim 21, wherein the means for providing utility delivery information for evaluation and analysis comprises means for providing information on at least one of delivery routes, delivery costs, loss costs, tariffs, taxes, transportation costs, and combinations thereof.

23. The system according to claim 1, wherein the means for determining steam amounts generated and used at the steam-consuming site and the means for analyzing and evaluating the steam amounts generated and used and the utility delivered comprise a computer.

24. The system according to claim 1, further comprising means for providing process variable information to the means for analyzing and evaluating the steam amounts generated and used.

25. The system according to claim 24, wherein the means for providing process variable information provides at least one of time, date, temperature, humidity, steam-consuming site location, and other process-influencing variables for the steam-consuming site.

26. The system according to claim 24, further comprising means for providing raw material data and information to the means for analyzing and evaluating the steam amounts generated and used.

27. The system according to claim 24, further comprising means for providing by-product and waste information to the means for analyzing and evaluating the steam amounts generated and used, wherein the by-product and waste are produced in a steam-consuming process at a steam-consuming site.

28. The system according to claim 24, further comprising means for providing product information to the means for analyzing and evaluating the steam amounts generated and used.

29. The system according to claim 1, wherein the means for analyzing and evaluating the steam amounts generated and used comprises at least a means selected from the group consisting of means for acquiring data, means for mining data, and means for analyzing data.

30. The system according to claim 29, wherein each of the means for acquiring data, means for mining data, and means for analyzing data comprises data acquisition software, data mining software, data analysis software, and combinations thereof.

31. The system according to claim 1, wherein the means for analyzing and evaluating the steam amounts generated and used comprises at least one means selected from the group consisting of means for purchasing steam, means for predicting steam use trends, means for planning steam-related decisions, means for purchasing energy, means for predicting energy price trends, and combinations thereof.

32. The system according to claim 31, wherein the means for purchasing steam, means for predicting steam use trends, means for planning steam-related decisions, means for purchasing energy, means for predicting energy use trends, means for predicting energy price trends, and combinations thereof comprises one of software and information provider.

33. The system according to claim 1, further comprising a web site that is connected to the means for analyzing and evaluating to communicate steam-related information and permits access to the analyzed and evaluated data and information and the steam-related information.

34. The system according to claim 33, wherein the web site permits a user interaction with at least one of the means for measuring, the means for determining, and the means for analyzing and evaluating.

35. The system according to claim 34, wherein the web site provides real-time analyzed and evaluated data and information and steam-related information.

36. The system according to claim 35, wherein the means for measuring utility amounts delivered comprises at least one meter, the web site is connected to each meter of the means for measuring, and the web site permits access to meter information.

37. The system according to claim 35, wherein the means for analyzing and evaluating the steam amounts generated and used comprises at least one data processing module, the web site is connected to each meter of the means for measuring, and the web site permits access to the at least one data processing module.

38. The system according to claim 35, wherein the means for analyzing and evaluating the steam amounts generated and used comprises means to provide utility delivery information for evaluation and analysis, the web site is connected to each meter of the means for measuring, and the web site permits access to the utility delivery information.

39. The system according to claim 1, wherein the means for analyzing and evaluating the steam amounts generated and used comprises quality analytic tools.

40. The system according to claim 1, wherein the means for analyzing and evaluating the steam amounts generated and used comprises predictive tools that can be used to predict at least one of future times for operation of steam-generating systems at the steam-consuming site as determined by the steam-generation management system and future times to purchase energy as determined by the steam-generation management system.

41. A steam-generation management method comprising the steps of:

measuring utility amounts delivered to a plurality of steam-consuming sites that are interconnected on a computer-based network, each of the plurality of steam-consuming sites comprising at least a steam-generating system; the utility comprising water, water treatment chemicals, energy, and fuel;

measuring process variables of the at least a steam-generating system and the plurality of steam-consuming sites;

determining steam amounts generated and used at the plurality of steam-consuming sites;

analyzing and evaluating the steam amounts generated and used and utility delivered to provide analyzed and evaluated data and information; and providing access to the analyzed and evaluated data and information and to steam-related information.

42. The method according to claim 41, wherein the step of measuring the utility amounts comprises a step of measuring utility delivered to at least one steam-consuming system.

43. The method according to claim 41, wherein the step of determining the steam amounts comprises a step of measuring steam from a plurality of steam-generating systems and a plurality of steam-consuming systems.

44. The method according to claim 41, wherein the step of measuring the utility amounts comprises measuring water, water treatment chemicals, energy, and fuel.

45. The method according to claim 41, wherein the step of measuring amounts of utility comprises measuring utility by metering the utility.

46. The method according to claim 45, wherein the step of metering comprises metering the utility amounts using a meter selected from the group consisting of digital meters, analog meters, mechanical meters, broad-band spectrum modems, process logic control meters, and combinations thereof.

47. The method according to claim 45, wherein the step of metering comprises disposing at least one meter on at least one delivery line that delivers utility to the steam-consuming site.

48. The method according to claim 47, wherein the step of disposing at least one meter comprises disposing at least one meter on the at least one delivery line and measuring a total utility amount delivered to the steam-consuming site via the at least one delivery line.

49. The method according to claim 41 further comprising interconnecting each of the means for measuring, means for determining, the means for analyzing and evaluating, and the means for providing.

50. The method according to claim 49, wherein the step of interconnecting comprises providing a communication link interconnecting each of the means for measuring, means for determining, the means for analyzing and evaluating, and the means for providing; the communications link being selected from the group consisting of phone modem, network connection, communication, radio communication and other wireless communication systems, cellular communication, satellite communication, web access communication, and Internet access communication, Intranet access communication, and combinations thereof.

51. The method according to claim 41, wherein the step of analyzing and evaluating the steam amounts generated and used comprises processing steam amounts using at least one data processing module.

52. The method according to claim 41, wherein each of the step of determining steam amounts generated and used at each of the plurality of steam-consuming sites and the step of analyzing and evaluating the steam amounts generated and used comprises processing steam amounts using at least one data processing module.

53. The method according to claim 41, wherein the step of analyzing and evaluating the steam amounts generated and used further comprises providing energy-provider information for evaluation and analysis.

54. The method according to claim 53, wherein the step of providing energy-provider information comprises providing real-time energy-provider information.

55. The method according to claim 54, wherein the step of providing energy-provider information comprises providing the energy-provider information in electronic form.

56. The method according to claim 54, wherein the step of providing energy-provider information comprises providing at least one of energy unit prices, delivery tariffs, energy taxes, and combinations thereof.

57. The method according to claim 41, wherein the step of analyzing and evaluating comprises providing utility delivery information for evaluation and analysis.

58. The method according to claim 52, wherein the step of providing delivery information comprises providing at least one of delivery routes, delivery costs, loss costs, tariffs, taxes, transportation costs, and combinations thereof.

59. The method according to claim 41, the method further comprising a step of providing process variable information for analyzing and evaluating the steam amounts generated and used.

60. The method according to claim 41, wherein the step of providing process variable information comprises providing at least one of time, date, temperature, humidity, steam-consuming site location, and other process variables for the steam-consuming site.

61. The method according to claim 41, the method further comprises the step of providing raw material data for analyzing and evaluating the steam amounts generated and used.

62. The method according to claim 41, the method further comprises the step of providing by-product and waste information for analyzing and evaluating the steam amounts generated and used, wherein the by-product and waste are produced in a steam-consuming process at a steam-consuming site.

63. The method according to claim 41, the method further comprises the step of providing raw material information for analyzing and evaluating the steam amounts generated and used.

64. The method according to claim 41, wherein the step of analyzing and evaluating the steam amounts generated and used further comprises at least one of acquiring data, mining data, and analyzing data.

65. The method according to claim 64, wherein the step of acquiring data, mining data, and analyzing data further comprises providing data acquisition software, data mining software, data analysis software, and combinations thereof.

66. The method according to claim 41, wherein the step of analyzing and evaluating the steam amounts generated and used further comprises developing for strategies for purchasing steam, for predicting steam use trends, for planning steam-related decisions, for purchasing energy, for predicting energy use trends, for predicting energy price trends, for planning energy-related decisions, and combinations thereof.

67. The method according to claim 41, the method further comprises communicating the analyzed and evaluated data and information and the steam-related information via a web site.

68. The method according to claim 67, wherein the method further comprises permitting feedback into at least one of the means for measuring, the means for determining, the means for analyzing and evaluating, and means for providing.

69. The method according to claim 67, wherein the step of communicating the analyzed and evaluated data and information and the steam-related information via a web site further comprises providing at least one of the analyzed and evaluated data and information and the steam-related information in real-time and historical data.

70. The method according to claim 67, wherein the step of analyzing and evaluating the steam amounts generated and used further comprises using at least one data processing module for analyzing and evaluating, and the method further comprises connecting a web site to said at least one data processing module.

71. The method according to claim 41, wherein the step of analyzing and evaluating the steam amounts generated and used comprises analyzing and evaluating the steam amounts generated and used employing quality analysis tools.

72. The method according to claim 41, wherein the step of analyzing and evaluating the steam amounts generated and used further comprises analyzing and evaluating the steam amounts generated and used employing quality predictive tools.

73. The method according to claim 72, wherein the step of analyzing and evaluating the steam amounts generated and used employing quality predictive tools further comprises the step of providing predictions at least one of future times for operation at the steam-consuming site as determined by the steam-generation management system and future times to purchase energy as determined by the steam-generation management system.

* * * * *